US005868125A

United States Patent [19]

Maoujoud

[11] Patent Number: 5,868,125

[45] **Date of Patent: *Feb. 9, 1999**

[54] CRENELATED ABRASIVE TOOL

[75] Inventor: Mohammed Maoujoud, Ulveling, Luxembourg

[73] Assignee: Norton Company, Worcester, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 749,370

[22] Filed: Nov. 21, 1996

[51] Int. Cl.[6] ..... B28D 1/04

[52] U.S. Cl. ..... 125/15; 451/547; 451/542; 76/112; 175/379

[58] Field of Search ..... 125/15; 457/547, 457/542, 543, 548; 76/112; 175/379, 403, 404

[56] References Cited

U.S. PATENT DOCUMENTS

| | | | |
|---|---|---|---|
| Re. 25,434 | 8/1963 | Christensen | 51/206 |
| 2,811,960 | 11/1957 | Fessel | 125/15 |

(List continued on next page.)

FOREIGN PATENT DOCUMENTS

| | | | |
|---|---|---|---|
| 2362339A1 | 6/1975 | Germany . | |
| 3029101A1 | 3/1981 | Germany . | |
| 57-33969 | 2/1982 | Japan | B24D 5/12 |
| 57-184674 | 11/1982 | Japan | B24D 5/12 |
| 63-207565 | 8/1988 | Japan . | |
| 05138646 | 6/1993 | Japan . | |
| 08243928 | 9/1996 | Japan . | |
| 2232619 | 12/1990 | United Kingdom . | |
| 92/01542 | 2/1992 | WIPO | B28D 1/12 |
| 95/31311 | 11/1995 | WIPO . | |

OTHER PUBLICATIONS

PCT International Search Report, PCT/US/97/17581, filed 30 Sep. 1997.

*Primary Examiner*—Robert A. Rose
*Assistant Examiner*—George Nguyen
*Attorney, Agent, or Firm*—Mary E. Porter

[57] ABSTRACT

An abrasive tool for cutting extremely abrasive-resistant materials includes a novel, abrasive segment with a generally crenelated, rectangular appearance. The segment has a single piece vein of a primary abrasive and first bond material extending completely along the length of the segment. The vein transverses the width of the segment at least once in a non-linear path and alternately coincides with inner and outer faces. Gaps between the vein and the faces opposite the vein coincident faces are occupied by a second bond material, and optionally, a secondary abrasive, thus forming multiple, separated abrasive regions. The bottom surface of the segment is attached to a core at an operative perimeter which defines the cutting edge of the tool. The segment can be adapted to conform to the curvature of diverse cutting edges, and thus can be used in rotary and reciprocating saw blades and core drilling bits. The crenelated construction of the abrasive segment provides a fast cutting, durable tool incorporating less of costly superabrasives, such as diamond, than comparable tools. Despite an intricate configuration of primary and secondary abrasives within the segment, the novel tool has enhanced structural integrity.

A method of making the novel abrasive tool is provided in which primary abrasive and first bond material are compacted to shape a vein preform which is presintered in a vein mold to produce a green vein. The green vein is placed in a segment mold and then second bond material and optional secondary abrasive are, deposited in cavities between the vein and segment faces to create separated abrasive regions. The segment is sintered to cure the bond material permitting the segment to be attached to the operative perimeter of the tool core as a unit. The method of making the abrasive tool is fast which contributes to low fabrication costs.

42 Claims, 5 Drawing Sheets

U.S. PATENT DOCUMENTS

| | | | |
|---|---|---|---|
| 3,016,661 | 1/1962 | Nielsen | 51/206 |
| 3,203,774 | 8/1965 | Pratt | 51/293 |
| 3,338,230 | 8/1967 | Lindblad | 125/15 |
| 4,275,528 | 6/1981 | Higginbotham | 51/206 |
| 4,407,263 | 10/1983 | Murata | 125/15 |
| 4,461,268 | 7/1984 | Inoue | 125/15 |
| 4,693,644 | 9/1987 | Takahashi . | |
| 4,883,500 | 11/1989 | Deskins et al. | 51/298 |
| 4,908,046 | 3/1990 | Wiand | 51/293 |
| 4,915,182 | 4/1990 | Magyari et al. | 175/403 |
| 5,392,759 | 2/1995 | Kwang | 125/15 |
| 5,429,199 | 7/1995 | Sheirer et al. | 175/321 |
| 5,433,187 | 7/1995 | Hayasaka et al. | 125/15 |
| 5,441,033 | 8/1995 | Chiuminatta et al. | 125/15 |
| 5,443,418 | 8/1995 | Frodin et al. | 451/540 |
| 5,518,443 | 5/1996 | Fisher | 125/15 |

CRENELATED ABRASIVE TOOL

FIELD OF THE INVENTION

This invention relates to a tool for cutting and grinding industrial materials, and, more particularly, to a tool with a crenelated, abrasive segment and a method of making such a tool.

BACKGROUND AND SUMMARY OF THE INVENTION

Abrasive tools have diverse industrial uses, such as drilling cores, grinding stock to make machine parts, and cutting construction materials, such as brick, tile, metal and concrete. These tools generally include one or more abrasive elements secured to a cutting edge of a rigid, preferably metal, core. The abrasive elements of these tools often essentially consist of hard, finely divided particulates embedded in a bonding material. The bonding material, among other things, maintains the abrasive element in a shape that enables the abrasive particles to produce the desired cutting effect on the work piece.

Moderately hard abrasives such as aluminum oxide, silicon carbide and like, can be used to cut many materials. Very hard, so-called superabrasives, such as diamond and cubic boron nitride, are preferred to cut tough, i.e., extremely abrasive-resistant, materials such as concrete. The cost of tools containing superabrasives is normally quite high because the superabrasive component is very expensive. There has been considerable interest in developing abrasive tools which cut tough materials well, yet are less costly than tools in which the abrasive component is exclusively a superabrasive.

One approach to making better abrasive tools has been to incorporate both superabrasive and non-superabrasive particles in the abrasive element. In this fashion a tool containing the same total volume of abrasive, but less superabrasive, can cut as well as a more expensive, 100% superabrasive tool. U.S. Pat. Nos. 5,152,810 and 4,944,773, for example, teach that surprisingly advantageous results and a significantly lowered cost can be attained by replacing part of the superabrasive component with a sol-gel alumina abrasive. U.S. Pat. No. 5,443,418 represents an advance in this technology. It discloses an abrasive tool in which at least one superabrasive component and essentially uniformly oriented filamentary particles of a microcrystalline alumina are dispersed in a bond material.

It has been recognized, however, that the performance of the combined superabrasive/non-superabrasive type of tool involves a compromise between speed of cut and tool life. Speed of cut is a measurement of how fast a given tool cuts into a particular type of material. Tool life is the duration that the blade of the tool remains effective. Generally, fast cutting abrasive tools have shorter lives and longer lasting tools cut slowly.

Certain segmented abrasive tools with circumferentially differentiated abrasive segments to provide certain operational improvements have been disclosed. Japanese Patent Application No. Sho 55-105068 dated Aug. 1, 1980, teaches that stone cutting noise level can be reduced by interposing non-diamond abrasive regions circumferentially between diamond abrasive regions of a cutting wheel. International Patent Publication No. WO 92/01542 discloses a cutting tool that achieves different wear properties by varying grain size, type and concentration and bond type over the length of the cutter segment with respect to the direction of rotation of the cutting tool.

Recently certain high performance abrasive tools which are improved in both speed of cut and tool life have been developed. For example, U.S. Pat. No. 5,518,443 discloses an abrasive tool that achieves an improved combination of high cutting speed and long life by contacting the work piece with alternating regions of preferentially concentrated abrasive grains.

The modern technology for making high speed cutting tools without loss of tool life generally involves providing preferential concentrations of different abrasive components in geometrically intricate, defined zones within cutting segments. Unfortunately, the methods of making abrasive tools with different abrasive concentrations and bond types in an abrasive element are complex and costly. Additionally, the newer abrasive elements are somewhat delicate compared to traditional elements. Hence, abrasive elements constructed with zones of diverse abrasive and bond types are susceptible to at least partially disintegrate prematurely during manufacture and in use.

Accordingly, it is an object of the present invention to provide a low manufacturing cost, high performance, abrasive tool capable of cutting tough materials such as concrete, tile, masonry and metal. More particularly, it is an object to provide an abrasive tool for cutting tough materials which incorporates less volume concentration of superabrasive component than a comparatively effective, exclusively superabrasive-containing tool.

Another object of this invention is to provide safe, freely-cutting, faster cutting, longer life cutting performance through an abrasive tool design that contains a plurality of discretely defined zones of different abrasive compositions in each abrasive segment.

Still another object of the present invention is to provide a high performance abrasive tool for tough materials which is simple, quick and inexpensive to produce despite having multiple zones of different types, concentrations and sizes of abrasive grains and bond materials in each abrasive segment.

A further object of this invention is to provide a facile method for producing abrasive segments for a high performance abrasive tool.

Yet another object of the present invention is to provide a structurally strong, multiple zoned abrasive segment capable of being produced and assembled into a high performance abrasive tool with less breakage than was heretofore available.

Due to the enhanced integrity and to the expeditious manufacturing method involved, it is expected that the novel tool can be made with superior productivity. That is, compared to conventional manufacture of intricately constructed abrasive tools, the energy and materials consumed to produce each tool and the unit rate of production will be improved. Therefore, a still further objective of this invention is to provide a high performance, tough-cutting abrasive tool which appreciably reduces the overall cost of a cutting task.

Accordingly, there is now provided a crenelated shaped abrasive segment exceptionally well suited to cut a wide variety of tough materials encountered in industry. The novel abrasive segment having an operative perimeter comprising a length along the operative perimeter;

an inner face separated by a segment width from an outer face substantially parallel to the inner face to define sides of the abrasive segment along the operative perimeter;

a vein comprising a primary abrasive and a first bond material, the vein extending continuously and completely along the length of the abrasive segment and transversing the segment width at least once to coincide alternately with a portion of each of the inner and outer faces to define longitudinal vein parts of substantially uniform vein width less than the segment width, and a transverse vein part connecting consecutive longitudinal vein parts; and a plurality of separated abrasive regions between the inner and outer faces and the vein comprising a second bond material.

Also according to this invention there is provided an abrasive tool comprising at least one, and preferably a plurality of crenelated abrasive segments attached to a rigid core. The crenelated abrasive segments can be employed advantageously to provide core drill bits, rotary reciprocating saw blades, and other abrasive tools.

There is further provided a method for making crenelated abrasive segments and a method making abrasive tools which includes attaching crenelated abrasive segments to a core.

DETAILED DESCRIPTION

Figure 1:
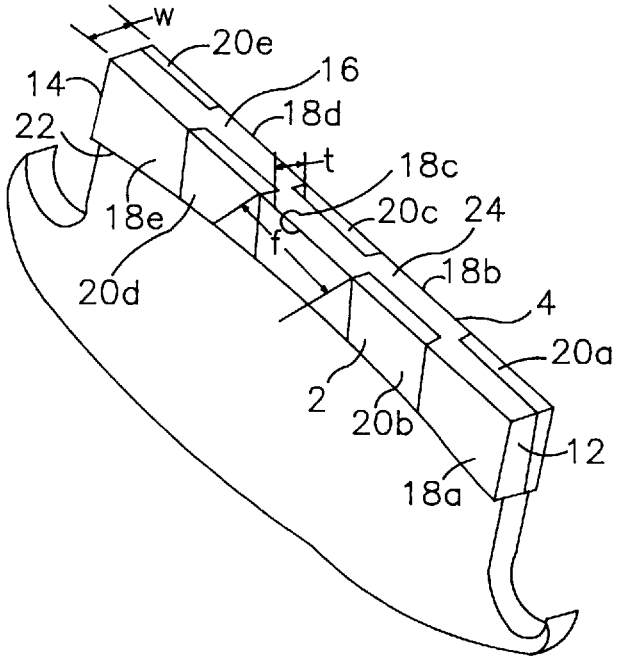
FIG. 1 is a perspective view of one embodiment of an abrasive segment adapted to a section of a saw blade according to the present invention.

In one form thereof, the invention is an abrasive segment for an abrasive tool which has a crenelated appearance as seen in FIG. 1. The abrasive segment has two substantially parallel faces designated inner face 2 and outer face 4, hidden from view. The faces form opposite sides of the segment. The abrasive segment is characterized by its length which extends from end 12 to end 14 and by segment width w defined by the distance between inner and outer faces. The abrasive segment contains a single vein 16 which extends continuously along the length in a non-linear path beginning on the inner face 2 at end 12, transversing the width multiple times, and ending on inner face 2 at end 14. The vein coincides alternately with surfaces 18*a*, 18*c* and 18*e* on the inner face, and with surfaces 18*b* and 18*d* on the outer face, hidden from view. The vein has a substantially uniform vein width t which is less than the segment width. Hence, the vein coincides with either the inner face or the outer face at each longitudinal position along the segment and remains coincident with that face for a face distance f along the length before transversing the segment width to coincide with the face on the opposite side of the abrasive segment.

An important aspect of this invention is that the vein extends continuously in a single piece from one end of the segment to the other. While not wishing to be limited to a particular theory, it is believed that continuous, single piece construction imparts great strength to the abrasive segment and facilitates manufacture of the abrasive tool.

At each longitudinal position along the segment length, the vein constitutes one side of the segment. The spaces between the vein and the face on the other side of the segment define separated abrasive regions 20*a*–20*e*. Both the vein and the separated abrasive regions extend over the full height from bottom surface 22, hidden from view, to the top surface 24 of the abrasive segment. The volume of each separated abrasive region is occupied by a second bond material. Optionally, a secondary abrasive can be dispersed within the second bond material.

It is significant that the vein transverses the segment width. In the most basic embodiment of the abrasive segment of this invention, the vein transverses the segment width one time to coincide with each of the inner and outer faces exactly one time along the length. The embodiment of FIG. 1 illustrates an abrasive segment in which the vein transverses between faces multiple times, and specifically, 4 times. It is thus apparent that the number of separated regions 20*a*–20*e* and the number of vein-face coincident surfaces 18*a*–18*e* per abrasive segment is equal to the number of times that the vein transverses the segment width plus one.

Figure 2A:
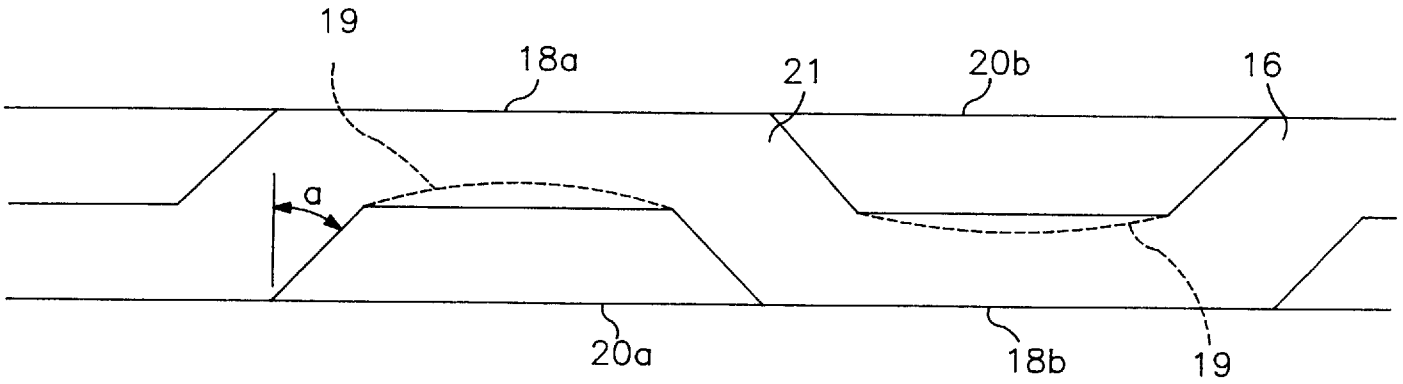
FIG. 2A is a plan view of a portion of an abrasive segment of this invention showing the vein transversing the segment obliquely.
Figure 2B:
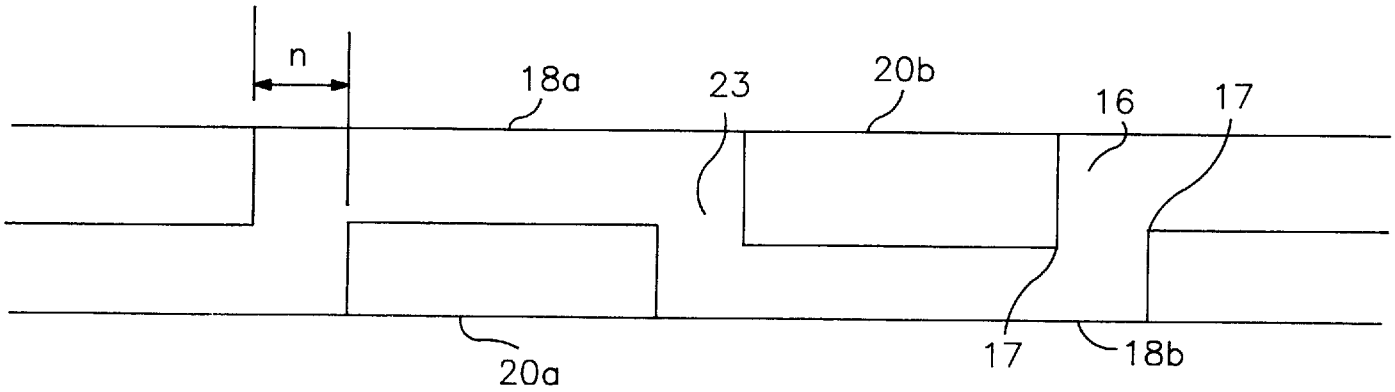
FIG. 2B is a plan view of a portion of an abrasive segment of this invention showing the vein transversing the segment perpendicularly to the inner and outer faces.

FIGS. 2A and 2B show in plan view different embodiments of vein 16 transversing the segment width to connect longitudinal vein parts 18*a* and 18*b* and thereby isolating separated abrasive regions 20*a* and 20*b*. In the figures, like elements are designated by like reference numerals. As shown in FIG. 2A, the transverse vein part 21 transverses obliquely at angle a with respect to the direction normal to the faces.

Because the vein preferably coincides with one face at every longitudinal position along the full length of the abrasive segment, the sum of face distances f, i.e., the sum of the longitudinal vein part lengths, should approximately equal one segment length. In addition, the longitudinal parts of the vein should alternate progressively along the length to coincide with the inner and outer faces. These characteristics assure that the primary and secondary abrasive portions of both surfaces contact any given point on the work piece alternately when the abrasive segment is in operative motion. It follows, therefore, that adjacent longitudinal vein parts, e.g., 18*a* and 18*b*, should not be appreciably offset lengthwise either by overlapping or by being too far apart. Hence, the absolute numerical value of oblique angle a should not be too large. Preferably, angle a is about 0 to 45 degrees, and more preferably, about 0 to about 30 degrees. FIG. 2B shows transverse vein part 23 exactly perpendicular to the faces. The width n of the transverse vein part in the longitudinal direction defines the distance of closest approach between neighboring separated abrasive segments. The transverse vein part width should be about as large as the longitudinal vein part width in order to provide the desired structural integrity. The maximum transverse vein part width is not particularly critical. However, it should be recognized that increasing the value of n raises the cost of the abrasive segment because the vein often contains an expensive, primary abrasive. Accordingly, n preferably should be in the range of about 0.5–2 times, and more preferably, about 0.9–1.1 times the longitudinal vein part width t.

Other embodiments are contemplated to be within the scope of the present invention. For example, the horizontal cross section interface between the vein and separated abrasive regions can exhibit curvature, as shown by the dashed lines 19 in FIG. 2A. Also, corners 17 can be rounded to relieve stress.

Figure 3:
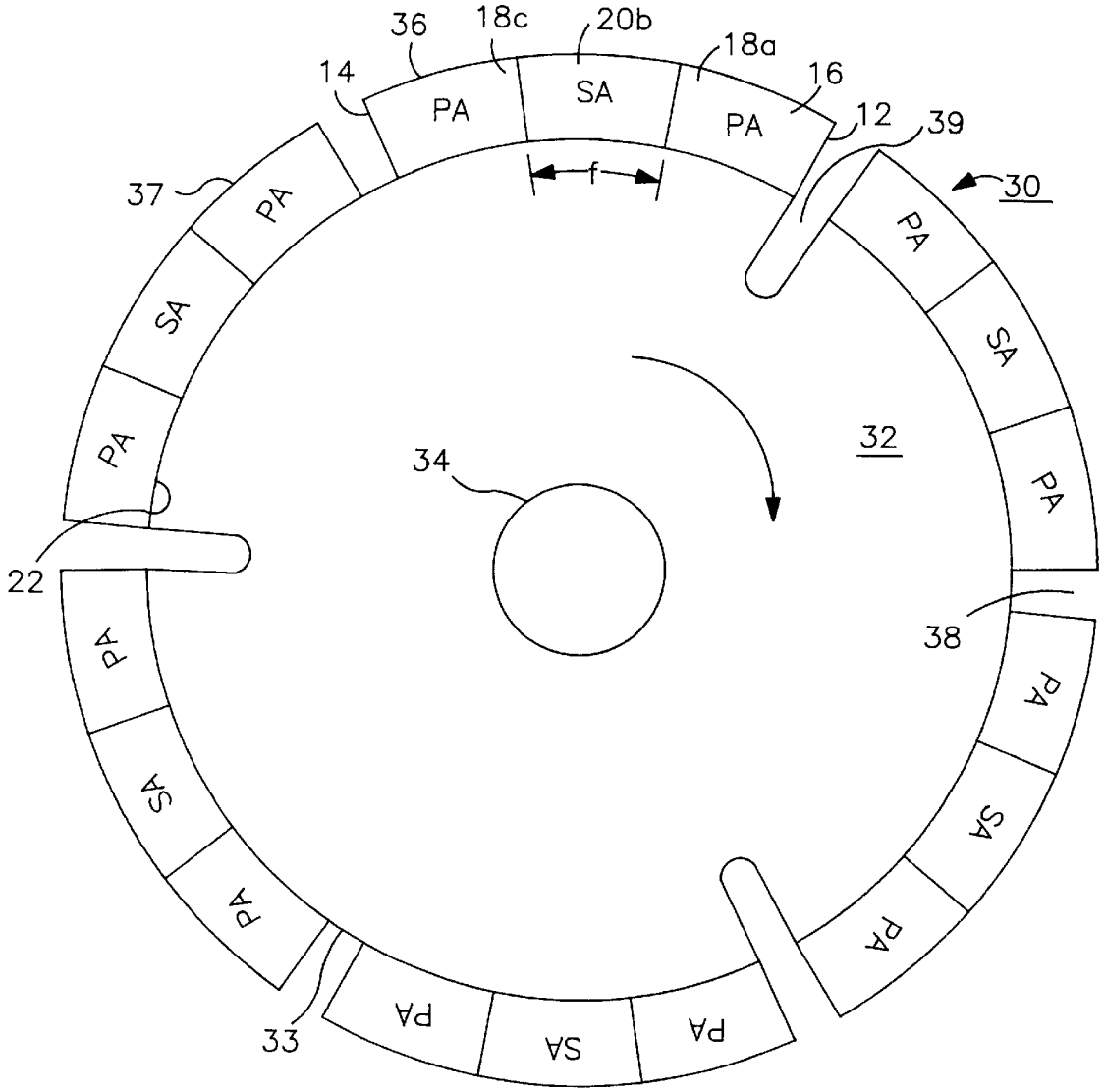
FIG. 3 is a side elevation view of an abrasive tool blade or wheel according the present invention.

As indicated above, the vein comprises a primary abrasive and a first bond material and the separated abrasive regions comprise a second bond material. The second bond material can be identical to or different from the first bond material. Optionally, a secondary abrasive can be dispersed within the second bond material. The secondary abrasive can be selected from among a wide variety of abrasive materials. However, it is important to achieving desired high performance that the abrasive strengths of the vein and the separated abrasive regions are different. The abrasive strength differential assures that any given point on the work piece will repetitively contact substances with different cutting characteristics as the tool is moved operatively against the work piece. This aspect of the invention is apparent from the side view, FIG. 3, showing that each of the inner and outer faces of the abrasive segment presents a sequence of primary and secondary abrasive portions alternating along the segment length.

When a secondary abrasive is used, a difference in abrasive strength can be obtained by employing a primary abrasive of different hardness grains than the secondary abrasive. The secondary abrasive grain material also can be identical to the primary abrasive grain. Of course, the primary and secondary abrasive grains will then have the same hardness. To obtain the desired abrasive strength differential in such case, the concentration of abrasive grains in the separated regions should be substantially different than in the vein. Generally, a portion of an abrasive segment containing high volume concentration of a given abrasive substance will be abrasively stronger than another portion containing a low volume concentration of the same abrasive substance. Accordingly, when the primary and secondary abrasive grains are the same, the volume concentration of abrasive in the vein should be higher than the volume concentration in the separated abrasive regions, for example, to achieve a higher abrasive strength in the vein. Preferably, the concentration in one portion of the segment should be at least about two times the concentration in the other portion.

The abrasive grains are uniformly dispersed within the bond material. Each of the primary and secondary abrasives can be a single abrasive substance or a mixture of more than one. Very hard abrasive substances, generally known as superabrasives, such as diamond and cubic boron nitride, can be used in the present invention. Non-superabrasive substances also can be employed. Representative non-superabrasives which can be used in this invention include aluminum oxide, silicon boride, silicon carbide, silicon nitride, tungsten carbide, garnet, pumice and the like. Superabrasives and non-superabrasives can be present in either or both of the primary and secondary abrasive portions.

A preferred non-superabrasive is a microcrystalline alumina, such as is described in U.S. Pat. No. 4,623,364 of Cottringer, et al., and U.S. Pat. No. 4,314,827 of Leitheiser, et al., both of which are incorporated herein by reference. Also preferred are the sol-gel alumina filamentary abrasive particles described in U.S. Pat. Nos. 5,194,072 and 5,201,916, incorporated herein by reference. "Microcrystalline alumina" means sintered sol-gel alumina in which the crystals of alpha alumina are of a basically uniform size which is generally smaller than about 10 $\mu$m, and more preferably less than about 5 $\mu$m, and most preferably less than about 1 $\mu$m in diameter. Crystals are areas of essentially uniform crystallographic orientation separated from contiguous crystals by high angle grain boundaries.

Sol-gel alumina abrasives are conventionally produced by drying a sol or gel of an alpha alumina precursor which is usually, but not essentially, boehmite; forming the dried gel into particles of the desired size and shape; then firing the pieces to a temperature sufficiently high to convert them to the alpha alumina form. Simple sol-gel processes are described, for example, in U.S. Pat. Nos. 4,314,827 and 4,518,397; and British Patent Application 2,099,012, the disclosures of which are incorporated herein by reference.

In a particularly desirable form of sol-gel process, the alpha alumina precursor is "seeded" with a material having the same crystal structure as, and lattice parameters as close as possible to, those of alpha alumina itself. The "seed" is added in as finely divided form as possible and is dispersed uniformly throughout the sol or gel. It can be added ab initio or it can be formed in situ. The function of the seed is to cause the transformation to the alpha form to occur uniformly throughout the precursor at a much lower temperature than is needed in the absence of the seed. This process produces a crystalline structure in which the individual crystals of alpha alumina are very uniform in size and are essentially all sub-micron in diameter. Suitable seeds include alpha alumina itself but also other compounds such as alpha ferric oxide, chromium suboxide, nickel titanate and a plurality of other compounds that have lattice parameters sufficiently similar to those of alpha alumina to be effective to cause the generation of alpha alumina from a precursor at a temperature below that at which the conversion normally occurs in the absence of such seed. Examples of such seeded sol-gel processes are described in U.S. Pat. Nos. 4,623,364; 4,744,802; 4,788,167; 4,881,971; 4,954,462; 4,964,883; 5,192,339; 5,215,551; and 5,219,806, the disclosures of which are incorporated herein by reference, and many others.

For a tool to cut tough materials, at least one of the abrasives in the vein or in the separated abrasive regions should include a superabrasive substance. It is usually desirable for the vein to have greater abrasive strength than the separated abrasive regions. Hence, the superabrasive substance preferably is a constituent of the primary abrasive. More preferably, the primary abrasive is a superabrasive and the secondary abrasive is non-superabrasive. While the secondary abrasive and second bond material can be different in each secondary abrasive region within a given abrasive segment, it should be easier to produce segments having identical compositions in all secondary abrasive regions within a segment. Hence, it is preferred that all the secondary abrasive regions in a segment are the same composition, i.e., secondary abrasive, second bond material and volume concentration of abrasive particles. In certain preferred embodiments, the primary abrasive is diamond or cubic boron nitride and the secondary abrasive is a microcrystalline alumina.

The crenelated abrasive segment according to the present invention is especially useful for cutting composite work pieces of tough materials. The term "composite work pieces" means materials which are heterogeneous mixtures of components that have significantly different resistance to abrasion. Building demolition material composed of metal cable, pipe and ceramics such as masonry and tile, and steel reinforced concrete are two good examples. Due to different abrasion resistances of metal and ceramic, it is frequently found that an ideal abrasive medium for one is not effective for the other. Moreover, one component of the composite can even prematurely wear out the abrasive medium chosen for its ability to cut the other component. The combination of primary and secondary abrasives in a single segment enables the abrasive tool of this invention to cut composite work pieces. In a preferred embodiment of a crenelated abrasive tool for cutting ceramic and metal composite work pieces, the primary abrasive is diamond and the secondary abrasive is cubic boron nitride, a cemented carbide, such as tungsten carbide, or a mixture of them.

The composition for the first and second bond materials can be any of the general types common in the art. For example, glass or vitrified, resinoid, or metal may be used effectively, as well as hybrid bond material such as metal filled resinoid bond material and resin impregnated vitrified bond. Metal and vitrified bond materials are preferred and metal is more preferred, especially for tools designed to cut tough materials encountered in the construction industry.

The compositions of the vein and/or the separated abrasive regions can optionally include porosity formers and other additives. Representative porosity formers and other additives include polytetrafluoroethylene, hollow ceramic spheres (e.g., bubble alumina) and particles of graphite, silver, nickel, copper, potassium sulfate, cryolite, and kyanite. When porosity formers are employed, the closed cell type, such as bubble alumina, is preferred to maintain structural integrity of the crenelated segment geometry.

In another form, the present invention is applicable to all abrasive tools in which the cutting action is performed by one or more segments attached to a core. The most common of such tools are core drilling bits, and rotary and reciprocating saw blades and cup wheels for grinding. The core of such abrasive tools is generally a durable, rigid structure, preferably hardened metal, such as tool steel. Rigid plastic cores, preferably of reinforced plastics, may be used. The core normally includes a means for holding the tool, for example, a shaft for a bit, a metal disc with a central hole for rotation of a wheel on an arbor, and a handle for gripping a hand tool. The core has an operative perimeter, and often, the tool includes a plurality of abrasive segments spaced apart along the operative perimeter. By "operative perimeter" is meant a curvilinear feature of a tool which defines the cutting edge or surface. For example, in a core drill bit, the operative perimeter is the circular end of the drill bit on which one or more abrasive segments is mounted. The operative perimeter of a rotary saw blade is the periphery of the circular core. In a tool with a curved operative perimeter such as a core drill bit and a rotary saw blade, the abrasive segment is curved or bowed along its length to conform the segment to the curvature of the operative perimeter. The crenelated abrasive segments described above are attached to the core, most frequently by being welded.

As described above, the crenelated abrasive segments are seen to have a basically rectangular prism form. Generally, the length of the abrasive segment is attached to the operative perimeter. Thus the abrasive segment is attached to the core in a manner that the inner and outer faces are presented perpendicularly to the surface of the work piece during cutting. The width of the abrasive segment is at least as great as the thickness of the edge of the core to which it is attached. The abrasive tools of this invention may be subject to the phenomenon known in the art as undercutting whereby the wall of the work piece being cut erodes the core as the tool penetrates the work piece. To prevent undercutting, the width is preferably slightly greater than the edge thickness.

FIG. 3 illustrates a side view of an abrasive tool blade according to the present invention. The wheel 30 includes a metal disc 32 bored with a central hole 34 for mounting the wheel on an axle of an arbor of a power-driven cutting apparatus to facilitate rotation of the wheel in the direction shown by the arrow. The bottom surfaces 22 of a plurality of abrasive segments 36 and 37 are attached by being welded along their lengths to the rim 33 of the metal disc. Each of the abrasive segments 36 and 37, is shown with the inner face towards the viewer, and is seen to comprise a vein 16 of primary abrasive, designated "PA", and several separated abrasive regions of secondary abrasive, e.g. 20*b,* designated "SA". The vein transverses between sides of each abrasive segment twice, and therefore three portions of the abrasive are visible in the figure. It should be readily apparent that a view of the wheel as seen from the opposite side would show two separated abrasive regions at the ends 12 and 14 and the primary abrasive of the vein coincident with the face of each abrasive segment. The abrasive segments are spaced apart along the rim by gaps, 38, which provide multiple leading ends 12 of abrasive segments to attack the work piece for each revolution of the wheel, among other things. The illustrated wheel also includes optional slots 39 extending radially from the rim toward the center of the disc. The purposes of the slots are to facilitate circulation of coolant which is often used in cutting operations, and to promote removal of debris cut from the work piece. Although slots are shown below alternate gaps between spaced apart segments, other configurations are possible and considered to be within the scope of the present invention. For example the slots can be present at each gap and at circumferential locations between gaps. Slot configuration parameters, such as the number, location, and depth, i.e., radial dimension, can be selected to suit the needs of a given cutting application by methods known in the art.

While the vein transverses all of the abrasive segments shown in FIG. 3 the same number of times and all of the inner faces of the segment are on the same side of the wheel, the scope of this invention is not so limited. Indeed, it can be appreciated that the configuration of the illustrated embodiment provides for disproportionate contact between primary abrasive and secondary abrasive with the work piece on opposite sides of the wheel. That is, the part of the work piece in contact with the side of the wheel shown will be contacted with twice as much primary abrasive as secondary abrasive, while the opposite will hold true on the other side. Such a disproportionate contact might be desirable for certain cutting applications, however, it is recognized that a more balanced proportion of primary abrasive to secondary abrasive contact is preferred for other applications. Accordingly, abrasive segments having different numbers of vein transversals can be implemented on the same wheel, and other segment configurations for balancing the proportion of abrasive contact can be used.

Another parameter which can be used to set the proportion of primary abrasive to secondary abrasive on each side of the tool is the face distance f. In FIG. 3, all of the face distances are identical. It is possible to design a crenelated abrasive segment tool according to this invention in which the face distances vary. For example, it is contemplated that the face distances of all the separated abrasive regions visible in FIG. 3 can be increased and the face distances of the visible PA faces correspondingly decreased to more closely balance the amount of primary and secondary abrasive exposed on this side of the wheel. Such a design change would have an equivalent effect on the opposite side of the wheel, where the fewer PA faces would be expanded and the more numerous separated abrasive regions would be contracted. Varying the face distances along the length of a segment might adversely affect structural integrity of the segment. In view of the fundamental objective to provide easily fabricated, robust abrasive segments, preferably all the face distances of each segment will be about equal.

In another aspect, the present invention can be a core drill bit. The core is a metal cylinder that is hollow at one end to define an operative perimeter which presents a circular cutting edge toward the work piece. The term "core" is used herein to designate a member of the abrasive tool that, among other things, supports the abrasive segments. The term "core drill bit" refers to a rotary abrasive tool which is normally used to drill an annular-shaped hole in a work piece. The other end of the cylindrical core, not shown, can be adapted to fit in a chuck of a drilling apparatus so that the bit can rotate about its central axis and advance axially into a work piece. The abrasive segments are attached to the end by welding the bottom surface of each segment to the core. The length of the generally rectangular abrasive segments is curved in arcuate form so as to conform to the curvature of the drill bit end. Due to the finite thickness of the cylinder, the segments are situated upon a circular lip, the edges of which have an inner radius and an outer radius, respectively. Preferably, the width and the curvature of the segments are such that the segments overhang the cylindrical core for free cutting and to prevent undercutting as described above. Hence, the inner face of the abrasive segment will be curved along a circular arc of radius less than the inner radius of the cylinder, and the outer face will be curved along a circular arc of radius larger than the outer radius of the cylinder.

In core drill bits, as in some abrasive blade applications, it is preferred that the bit be "reversible". That is, the bit can be operated by revolving either clockwise or counterclockwise about its central axis. To assure that the attacking edge presented by each segment toward the work is the same when the bit revolution is reversed, it is preferred that crenelated segments are employed in which the vein of every abrasive segment transverses the segment width an even number of times. This provides an odd number of separated abrasive regions per segment and assures that the segment is longitudinally symmetrical. In a particularly preferred abrasive segment the vein transverses the segment width twice.

Figure 4:
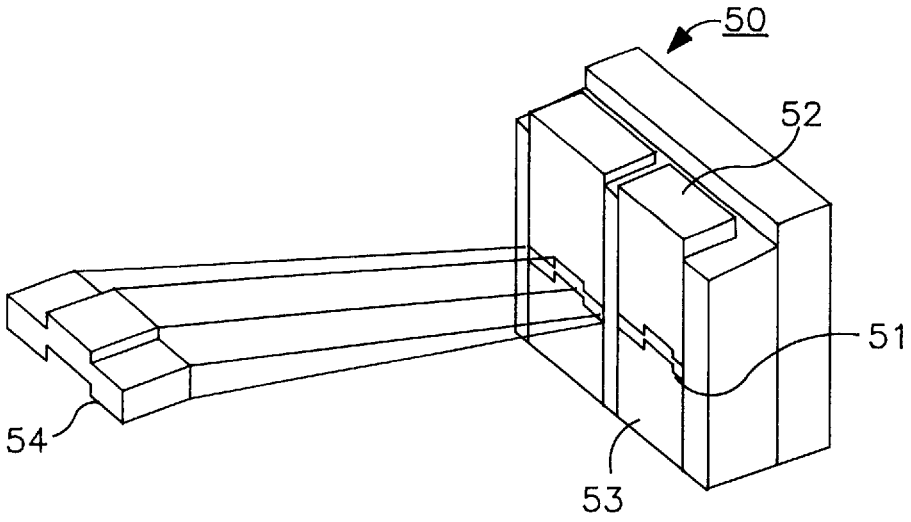
FIG. 4 is a perspective view of a mold useful for shaping the vein in a method of making the novel abrasive tool.
Figure 6A:
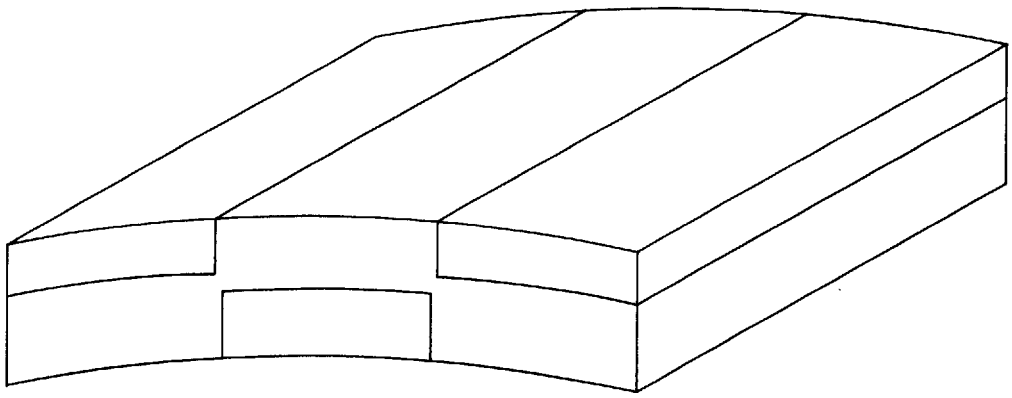
FIG. 6A is a perspective view of an O-configuration crenelated abrasive segment further described in the examples.
Figure 6B:
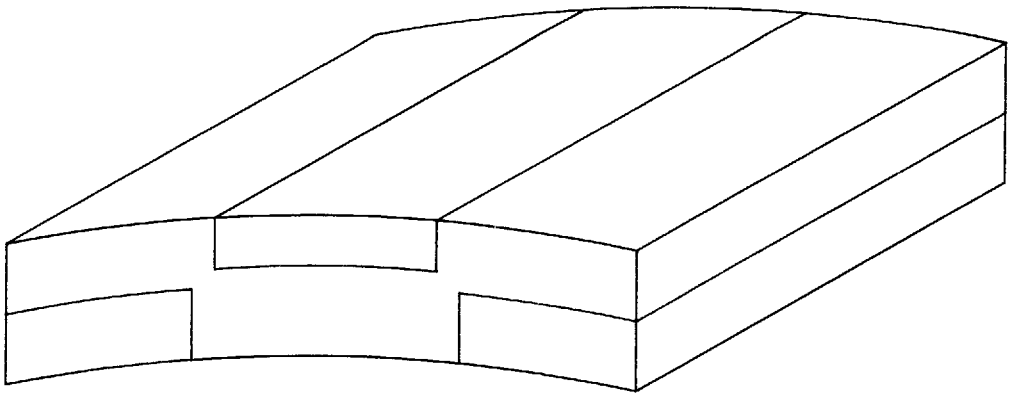
FIG. 6B is a perspective view of an I-configuration crenelated abrasive segment further described in the examples.

Also as seen in FIGS. 6A and 6B, core drill bit abrasive segments can be identified by an O-configuration, exemplified by FIG. 6A, and an I-configuration, exemplified by FIG. 6B. Alternating configurations, wherein every other segment is an O-configured segment, is shown in FIG. 4A. These configuration designations apply to segments in which the vein transverses the width an even number of times to provide an odd number of separated abrasive regions. The vein in such segments will curve to conform to the curvature of the operative perimeter in one of two ways: for an O-configured segment the vein will coincide with the outer face, i.e., the face corresponding to outside of the bit, an odd number of times; and for an I-configured segment, the vein will coincide with the inner face an odd number of times. The order of disposing segment configurations along the operative perimeter of the bit can be varied to achieve different cutting characteristics.

The abrasive segment configurations can be clustered in groups. Other combinations can be selected including combinations of more than two types of segments on one abrasive tool. For example, tools containing segments in which the vein transverses the segment width an odd number of times can populate the tool together with O-configured and I-configured segments.

The abrasive segments according to the present invention are amenable to a modular method of fabrication. Generally, the bond materials used in the present invention are supplied in fluid form, such as a viscous liquid or a free flowing, fine powder. Ultimately the bond materials will be cured, typically by thermal fusion or chemical reaction, to a solid embedding the respective abrasive particles. Initially, the primary abrasive and first bond material are mixed to a uniform dispersion containing the desired volume concentration of abrasive in bond. Preferably the composition has a paste-like consistency suitable to hold form when compacted, yet sufficiently fluid to be dispensed into a mold 50 of the type shown in FIG. 4. The dispersion is deposited in the cavity 51 between top ram 52 and bottom ram 53. The rams are urged together without heating to preform the vein 54 of the segment. The vein preform is subsequently "pre-sintered" or cold compacted to achieve a "green" vein having at least about 50–55% of the theoretical density. The term "theoretical density" means the weight-averaged density of the pure components of the bond material. For example, the theoretical density of a hypothetical 80 wt % Cu (density 8.8 g/cm$^3$)/20 wt % Sn (density 7.3 g/cm$^3$) would be 8.5 g/cm$^3$ and the cold compacted green vein density should be at least about 4.2–4.7 g/cm$^3$. Pre-sintering can be performed at about 650°–700° C. in a belt furnace under an inert gas atmosphere, such as a $H_2/N_2$ mixture, or at about 750°–780° C. by induction heating for about 120 s, or by cold compacting. In this context, "green" means that the vein is not sufficiently strong to maintain structural integrity in cutting service but has sufficient, so-called "green strength" to retain its shape for handling in subsequent fabrication process steps. Graphite carbon contamination should be avoided at this stage of the fabrication process, especially when pre-sintering is involved. Although graphite-containing molds can be used in concert with a blanket of inert gas or under vacuum, ceramic molds are preferred to eliminate graphite contamination. Steel molds can be used for cold compacting process steps. In an optional variation, a longer green vein than needed can be made in the vein mold and subsequently cut by laser to appropriate length.

Figure 5:
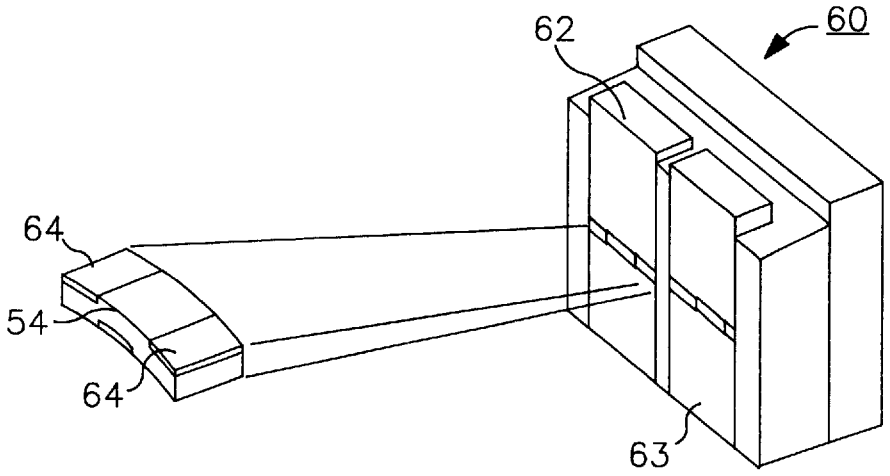
FIG. 5 is a perspective view of a mold useful for completing the segment shape in a method of making the novel abrasive tool.

In another step, the secondary abrasive and second bond material are mixed to a uniform dispersion of desired volume concentration of abrasive in bond. As seen in FIG. 5, the vein preform 54 is moved to mold 60 with suitably shaped top ram 62 and bottom ram 63. The secondary abrasive dispersion is deposited in the cavities between the vein and the rams to create the separated abrasive regions 64. The composite segment is compressed at about 4,000–7,500 pounds per square inch pressure and about 750° C.–975° C. for approximately 180–200 s to completely cure the bond materials thereby forming the crenelated abrasive segment of this invention. These curing conditions are typical for metal bond materials. Actual curing temperatures will vary depending upon the nature of the selected bond materials.

After the crenelated segments are fabricated they can be attached to the core by various methods known in the art, such as brazing or laser welding. The modular method for fabricating crenelated abrasive segments is particularly well suited for laser welding. A laser weldable second bond material can be used advantageously both to form the separated abrasive regions and to provide a laser weldable bottom surface for attaching the segment to the core. This is accomplished by using a segment mold made slightly taller than the final dimension of the segment. For example an 8 mm tall mold can be used to make a 7 mm tall segment. The vein is placed in the segment mold with the top surface abutting the mold wall and leaving a thin strip cavity along the bottom surface. The laser weldable second bond material is added to the mold so as to fill the separated regions and form a strip on the bottom of the segment. Forming a crenelated segment in this manner presents the further advantage that the separated regions are uniformly and completely filled with second bond material when the segment mold is closed and compressed. Laser welding is a preferred method of attaching the segment to the core for making tools designed for dry cutting applications.

EXAMPLES

Example 1

Manufacture of Core Drill Bits

Core drill bits with multiple crenelated segments mounted on a metal core were prepared as follows:

Vein compositions: Three vein compositions with type 35/40 U.S. mesh size metal coated diamond grain (high grade saw grit) concentration in the range of 10.6 to 15% by volume in a first bond material were prepared. A free flowing powder mixture, VC1, was made by blending a metal powder comprising cobalt particles with the diamond grains. Another vein powder mixture, VC2, was similarly prepared from the same diamond grains and a metal powder mixture comprising cobalt particles and copper/tin powder. Still another powder mixture, VC3, was prepared in like manner using the diamond grains and a metal powder blend comprising copper/tin powder, iron particles and chromium boride. The particle sizes of all metal powders were smaller than 400 U.S. mesh.

Separated abrasive region compositions: Three powder mixtures were prepared by blending a secondary abrasive with second bond material mixtures. In one powder mixture, SARC1, the secondary abrasive was 2 volume % of a seeded sol-gel alpha alumina. The second bond material in SARC1 was a metal powder comprising copper/tin and cobalt powders. The maximum particle sizes of the powders was 200 U.S. The second powder mixture, SARC2, was 21 wt % tungsten carbide particles (>325 U.S. mesh) coated with cobalt powder, and a blend of metal powders comprising copper/tin particles, nickel/chromium particles, iron, and chromium boride. All particles in SARC2 were smaller than 100 U.S. mesh size. The third powder mixture, SARC3, was a blend of cubic boron nitride with the second powder mixture.

Segment fabrication: Crenelated core drill bit abrasive segments were prepared from various combinations of vein compositions VC1–VC3 and separated abrasive region compositions SARC1–SARC3. The O-configured and I-configured, crenelated abrasive segment geometries are shown in FIGS. 6A and 6B, respectively, in which all dimensions shown are millimeters. Each segment was nominally 3 mm wide×7 mm high×24 mm long providing a total segment volume of approximately 0.504 $cm^3$. Nominal vein volume was 70% of the total. Diamond content was in the range of 0.65 to 0.75 carat per total of the crenelated segment.

Each segment was produced by first placing a selected vein composition in a preshaped vein mold suitable for forming a green vein of the geometry shown in FIGS. 6A and 6B. The filled vein mold was heated to 750°–780° C. and compacted at 1000 psi for 120 s, which formed a green vein with over 50% of theoretical density. The mold was constructed of graphite.

Subsequently, the green vein was placed in a segment mold and the cavities for the separated abrasive regions were filled with a selected SARC powder mixture. Before sintering, the mold was compressed at ambient temperature to compact the SARC powder mixture around the vein. The mold was then compressed at about 750° C. for about 180–200 s to sinter materials thereby producing the final abrasive segment.

Nine crenelated abrasive segments fabricated as described above were brazed by the bottom surfaces to the end of a 10.2 cm (4 inch) diameter, steel tube. Two such bits were assembled, specifically, a nine O-configuration bit and a successively alternating, five O-configuration/four I-configuration bit. The opposite end of the tube was shaped for mounting in the chuck of a power drill.

Example 2 and Comparative Examples 1–4

A core drilling bit according to the present invention and four non-crenelated abrasive segment bits were placed in service on a core drill test machine under conditions and with results as shown in Table 1. All bits tested were 10.2 cm diameter. The drill bits tested were as follows:

Ex. 2: The tool had nine crenelated segments of diamond primary abrasive vein composition VC2 and tungsten carbide secondary abrasive SARC2 in the separated abrasive region composition regions. The tool was fabricated according to the procedure described in Example 1.

Comp. Ex. 1: This bit had multiple abrasive segments. The abrasive segments consisted of a bond material with a layer of seeded, sol-gel alumina rods on the outside cutting surfaces of one half of the segments and the inside cutting surfaces of the other segments.

Comp. Ex. 2: This bit had the same construction as Comp. Ex. 1 except that outside and inside cutting surfaces of all the segments were hardened with seeded, sol-gel alumina rods.

Comp. Ex. 3: This bit had the same construction as Comp. Ex. 1 except that alternate outside and inside cutting surfaces were hardened with the sol-gel alumina rods and seeded, sol-gel alumina particles were dispersed throughout the bond material.

Comp. Ex. 4: A commercial production core drilling bit from Norton Co., Worcester, Mass.

The bits of Comp. Ex. 1–3 were near-production prototypes manufactured on commercial production equipment. The tests were run by drilling cured concrete work pieces using a high power concrete core drill adapted to measure and record speed, power and rate of penetration during operation.

Table 1 shows that Ex. 2 and Comp. Ex. 1–3 bits all had faster rate of penetration (ROP) and substantially greater wear performance than Comp. Ex. 4, the production bit. It should be noted, however, that Comp. Ex. 4 bit was specially designed to be driven by low power drill motors. Attempts to operate at the same conditions as the other bits made the low power bit bald and dull. Repeated attempts to dress the low power bit did not solve the problem. Accordingly, the conditions for the limited data shown in the table for this bit do not overlap those of the other bits.

Ex. 2 significantly exceeded the wear performance of Comp. Ex. 1–3 at low speed and at 900 rev./min. with low current. Only at high speed and high current did the Comp. Ex. 2 bit slightly out perform Ex. 2. However, at this condition, the bit according to the present invention demonstrated a 67% cutting speed improvement (ROP 6.2 vs. 3.7). The novel bit exhibited extraordinarily exceptional wear performance at respectable ROP under high speed, low current conditions. The Ex. 2 bit was slightly less free cutting than Comp. Ex. 1–3 bits. It was quite robust and the data show superior performance over a wide range of speeds and weight-on-bit.

Although specific forms of the invention have been selected for illustration in the drawings and examples, and the preceding description is drawn in specific terms for the purpose of describing these forms of the invention, this description is not intended to limit the scope of the invention which is defined in the claims.

TABLE 1

| Bit | Speed (Rev./min.) | Amps | Test Interval (Cores) | Rate of Penetration (cm/min) | Wear Performance (meters/mm) |
|---|---|---|---|---|---|
| Ex. 2 | 900 | 22 | 4–8 | 6.2 | 7.9 |
| | 450 | 22 | 9–11 | 5.6 | 1.5 |
| | 450 | 17 | 13–17 | 5.4 | 2.6 |
| | 900 | 17 | 18–27 | 3.6 | 16 |
| Comp. Ex. 1 | 900 | 22 | 6–10 | 5.5 | 1.5 |
| | 450 | 22 | 11 | 4.5 | 0.20 |
| | 450 | 17 | 12–13 | 4.1 | 0.43 |
| | 900 | 17 | 14–18 | 4.4 | 1.3 |
| Comp. Ex. 2 | 900 | 22 | 2–7 | 3.7 | 8.6 |
| | 450 | 22 | 8–9 | 4.2 | 0.66 |
| | 450 | 17 | 10–12 | 4.0 | 0.75 |
| | 900 | 17 | 13–21 | 4.0 | 2.5 |
| Comp. Ex. 3 | 900 | 22 | 4–10 | 5.4 | 1.5 |
| | 450 | 22 | 11 | 4.7 | 0.25 |
| | 450 | 17 | 12 | 3.8 | 0.085 |
| | 900 | 17 | 13–17 | 4.8 | 1.0 |
| Comp. Ex. 4 | 450 | 11 | 1–4 | 3.6 | 0.92 |
| | 900 | 11 | 5–18 | 3.0 | 4.3 |

* * * * *

What is claimed is:

1. An abrasive segment having an operative perimeter comprising a length along the operative perimeter;

an inner face separated by a segment width from an outer face substantially parallel to the inner face to define sides of the abrasive segment along the operative perimeter;

a vein comprising a primary abrasive and a first bond material, the vein extending continuously and completely along the length of the abrasive segment and transversing the segment width at least once to coincide alternately with a portion of each of the inner and outer faces to define longitudinal vein parts of substantially uniform vein width less than the segment width and a transverse vein part connecting consecutive longitudinal vein parts; and a plurality of separated abrasive regions comprising a second bond material, said regions being oriented between the inner and outer faces and the vein.

2. The abrasive segment of claim 1 wherein the primary abrasive is selected from the group consisting of diamond, cubic boron nitride and mixtures thereof.

3. The abrasive segment of claim 1 wherein the second bond material is the same as the first bond material.

4. The abrasive segment of claim 2 wherein each separated abrasive region further comprises a secondary abrasive.

5. The abrasive segment of claim 4 wherein the primary abrasive is selected from the group consisting of diamond, cubic boron nitride and mixtures thereof.

6. The abrasive segment of claim 5 wherein the secondary abrasive is the same as the primary abrasive and wherein the volume concentration of the primary abrasive in the vein is at least two times the volume concentration of the secondary abrasive in the separated abrasive regions.

7. The abrasive segment of claim 5 wherein the primary abrasive is harder than the secondary abrasive.

8. The abrasive segment of claim 7 wherein the secondary abrasive is selected from the group consisting of aluminum oxide, silicon carbide, tungsten carbide, silicon boride and silicon nitride and mixtures thereof.

9. The abrasive segment of claim 7 wherein the secondary abrasive is microcrystalline alpha alumina.

10. The abrasive segment of claim 1 wherein all the longitudinal vein parts have substantially the same length along the operative perimeter.

11. The abrasive segment of claim 10 wherein the vein transverses the segment width an even number of times.

12. The abrasive segment of claim 11 wherein the vein transverses the segment width twice.

13. The abrasive tool of claim 1 wherein the vein transverses the segment width at an oblique angle in the range of about 0°–45° with respect to a direction normal to the inner and outer faces.

14. The abrasive tool of claim 13 wherein the transverse vein part has a vein width in the range of 0.5–2 times that of the longitudinal vein part.

15. An abrasive tool comprising:

a core having an operative perimeter; and at least one abrasive segment disposed along the operative perimeter, each abrasive segment comprising a length along the operative perimeter;

an inner face separated by a segment width from an outer face substantially parallel to the inner face to define sides of the abrasive segment along the operative perimeter;

a vein comprising a primary abrasive and a first bond material, the vein extending continuously and completely along the length of the abrasive segment and transversing the segment width at least once to coincide alternately with a portion of each of the inner and outer faces to define longitudinal vein parts of substantially uniform vein width less than the segment width and a transverse vein part connecting consecutive longitudinal vein parts; and a plurality of separated abrasive regions comprising a second bond material, said regions being oriented between the inner and outer faces and the vein.

16. The abrasive tool of claim 15 wherein the primary abrasive is selected from the group consisting of diamond, cubic boron nitride and mixtures thereof.

17. The abrasive tool of claim 15 wherein the second bond material is the same as the first bond material.

18. The abrasive tool of claim 16 wherein each separated abrasive region further comprises a secondary abrasive.

19. The abrasive tool of claim 18 wherein the primary abrasive is selected from the group consisting of diamond, cubic boron nitride and mixtures thereof.

20. The abrasive tool of claim 19 wherein the secondary abrasive is the same as the primary abrasive and wherein the volume concentration of the primary abrasive in the vein is at least two times the volume concentration of the secondary abrasive in the separated abrasive regions.

21. The abrasive tool of claim 19 wherein the primary abrasive is harder than the secondary abrasive.

22. The abrasive tool of claim 21 wherein the secondary abrasive is selected from the group consisting of aluminum oxide, silicon carbide, tungsten carbide, silicon boride and silicon nitride and mixtures thereof.

23. The abrasive tool of claim 21 wherein the secondary abrasive is microcrystalline alpha alumina.

24. The abrasive tool of claim 15 wherein all the longitudinal vein parts have substantially the same length along the operative perimeter.

25. The abrasive tool of claim 24 wherein the vein of every abrasive segment transverses the segment width an even number of times.

26. The abrasive tool of claim 25 wherein the vein transverses the segment width twice.

27. The abrasive tool of claim 15 wherein the vein transverses the segment width at an oblique angle in the range of about 0°–45° with respect to a direction normal to the inner and outer faces.

28. The abrasive tool of claim 27 wherein the transverse vein part has a vein width in the range of 0.5–2 times that of the longitudinal vein part.

29. The abrasive tool of claim 15 comprising a plurality of abrasive segments spaced apart along the operative perimeter.

30. The abrasive tool of claim 29 wherein the core includes a slot extending inward from the operative perimeter between selected adjacent abrasive segments.

31. A core drill bit according to claim 29 wherein the core is a metal cylinder hollow at one end to define a circular operative perimeter having inner and outer radii; and wherein the abrasive segments curve arcuately along the operative perimeter such that the inner face has a radius of arcuate curvature less than the inner radius and the outer face has a radius of arcuate curvature greater than the outer radius.

32. The core drill bit of claim 31 wherein some of the abrasive segments are O-configured segments defined by the vein coinciding with the outer face an odd number of times, and all other abrasive segments are I-configured segments defined by the vein coinciding with the inner face an odd number of times.

33. The core drill bit of claim 32 wherein a plurality of O-configured segments are ordered consecutively along the operative perimeter and wherein a plurality of I-configured segments are ordered consecutively along the operative perimeter.

34. The core drill bit of claim 32 wherein the O-configured segments and the I-configured segments are ordered alternately along the operative perimeter.

35. The core drill bit of claim 31 wherein all the longitudinal vein parts have substantially the same length along the operative perimeter.

36. A rotary saw blade according to claim 29 wherein the core is a circular metal disk and the abrasive segments are disposed along the periphery of the disk.

37. The rotary saw blade of claim 36 wherein the core includes a slot extending inward from the operative perimeter between selected adjacent abrasive segments.

38. The rotary saw blade of claim 36 wherein all the longitudinal vein parts have substantially the same length along the operative perimeter.

39. A reciprocating saw blade according to claim 15 wherein the core is a metal sheet having a substantially linear operative perimeter.

40. The reciprocating saw blade of claim 39 wherein the vein of every abrasive segment transverses the segment width an even number of times.

41. The reciprocating saw blade of claim 40 wherein the core includes a slot extending inward from the operative perimeter between selected adjacent abrasive segments.

42. The reciprocating saw blade of claim 39 wherein all the longitudinal vein parts have substantially the same length along the operative perimeter.

* * * * *